US007686861B2

(12) United States Patent
Oh

(10) Patent No.: US 7,686,861 B2
(45) Date of Patent: Mar. 30, 2010

(54) DUST COLLECTING APPARATUS FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 652 days.

(21) Appl. No.: 11/603,769

(22) Filed: Nov. 22, 2006

(65) Prior Publication Data

US 2007/0289266 A1 Dec. 20, 2007

Related U.S. Application Data

(60) Provisional application No. 60/814,616, filed on Jun. 16, 2006.

(30) Foreign Application Priority Data

Jul. 24, 2006 (KR) ..... 10-2006-0069378

(51) Int. Cl.
*B01D 53/00* (2006.01)

(52) U.S. Cl. ..... 55/429; 55/337; 55/345; 55/346; 55/343; 55/DIG. 3; 15/353; 15/352; 96/416

(58) Field of Classification Search ..... 55/429, 55/337, 345, 346, DIG. 3; 15/353; 96/416
See application file for complete search history.

(56) References Cited

U.S. PATENT DOCUMENTS

| | | | | |
|---|---|---|---|---|
| 5,145,499 | A * | 9/1992 | Dyson | 55/337 |
| 6,210,457 | B1 * | 4/2001 | Siemers | 55/429 |
| 6,463,622 | B2 * | 10/2002 | Wright et al. | 15/353 |
| 6,558,453 | B2 * | 5/2003 | Sepke et al. | 95/268 |
| 6,818,036 | B1 * | 11/2004 | Seaman | 55/426 |
| 6,840,972 | B1 * | 1/2005 | Kim | 55/337 |
| 6,863,702 | B2 * | 3/2005 | Sepke et al. | 55/337 |
| 7,097,680 | B2 * | 8/2006 | Oh | 55/343 |
| 7,162,770 | B2 * | 1/2007 | Davidshofer | 15/353 |
| 7,198,656 | B2 * | 4/2007 | Takemoto et al. | 55/337 |
| 7,222,392 | B2 * | 5/2007 | McCormick et al. | 15/353 |
| 7,335,242 | B2 * | 2/2008 | Oh | 55/343 |
| 7,343,643 | B2 * | 3/2008 | Kondo | 15/353 |
| 7,419,522 | B2 * | 9/2008 | Arnold | 55/345 |

(Continued)

FOREIGN PATENT DOCUMENTS

| | | |
|---|---|---|
| JP | 2004-033241 A | 2/2004 |

(Continued)

*Primary Examiner*—Jason M Greene
*Assistant Examiner*—Dung Bui
(74) *Attorney, Agent, or Firm*—Ohlandt, Greeley, Ruggiero & Perle, L.L.P

(57) ABSTRACT

A dust collecting apparatus which is removably connected to a cleaner body is provided. The apparatus includes a cyclone body which forms a cyclone chamber and is in fluid communication with an air inlet passage on one side thereof; an exit pipe which is protruded from a bottom of the cyclone body to an upper side of the cyclone chamber; and a dust canister body which forms a dust collection chamber between the cyclone body and the dust canister body. The cyclone body is arranged eccentrically within the dust collection chamber so that a portion of the cyclone body has a common portion in contact with a portion of the dust canister body. The common portion is made of transparent materials to see through the cyclone chamber.

10 Claims, 6 Drawing Sheets

U.S. PATENT DOCUMENTS

| | | | | |
|---|---|---|---|---|
| 2002/0046438 | A1* | 4/2002 | Oh | 15/353 |
| 2003/0167590 | A1* | 9/2003 | Oh | 15/347 |
| 2003/0233938 | A1* | 12/2003 | Sepke et al. | 95/268 |
| 2004/0163207 | A1* | 8/2004 | Oh | 15/353 |
| 2004/0194437 | A1* | 10/2004 | Macleod et al. | 55/337 |
| 2004/0231091 | A1* | 11/2004 | Oh | 15/347 |
| 2005/0138763 | A1* | 6/2005 | Tanner et al. | 15/353 |
| 2005/0160554 | A1* | 7/2005 | Ueyama et al. | 15/353 |
| 2005/0177974 | A1* | 8/2005 | Conrad et al. | 15/353 |
| 2005/0223520 | A1* | 10/2005 | Greene et al. | 15/353 |
| 2006/0016043 | A1* | 1/2006 | Matsuhashi et al. | 15/353 |
| 2006/0059874 | A1* | 3/2006 | Cho et al. | 55/428 |
| 2006/0123590 | A1* | 6/2006 | Fester et al. | 15/353 |
| 2006/0207231 | A1* | 9/2006 | Arnold | 55/337 |
| 2006/0236665 | A1* | 10/2006 | Burnham | 55/428 |
| 2006/0254226 | A1* | 11/2006 | Jeon | 55/345 |
| 2006/0272299 | A1* | 12/2006 | Choi | 55/337 |
| 2007/0011998 | A1* | 1/2007 | Yoo et al. | 55/337 |
| 2007/0067944 | A1* | 3/2007 | Kitamura et al. | 15/353 |
| 2007/0079473 | A1* | 4/2007 | Min et al. | 15/353 |
| 2007/0079580 | A1* | 4/2007 | Oh | 55/345 |
| 2007/0079584 | A1* | 4/2007 | Kim et al. | 55/345 |
| 2007/0079585 | A1* | 4/2007 | Oh et al. | 55/345 |
| 2007/0084158 | A1* | 4/2007 | Fester | 55/337 |
| 2007/0084160 | A1* | 4/2007 | Kim | 55/345 |
| 2007/0095029 | A1* | 5/2007 | Min et al. | 55/345 |
| 2007/0130895 | A1* | 6/2007 | Boeck et al. | 55/429 |
| 2007/0220845 | A1* | 9/2007 | Smith | 55/345 |
| 2008/0134462 | A1* | 6/2008 | Jansen et al. | 15/347 |

FOREIGN PATENT DOCUMENTS

| | | | |
|---|---|---|---|
| JP | 2004-105538 | A | 4/2004 |
| JP | 2004229827 | A | 8/2004 |
| KR | 1020050005611 | A | 1/2005 |
| KR | 100560967 | | 3/2006 |
| WO | WO2004/093631 | | 11/2004 |

* cited by examiner

DUST COLLECTING APPARATUS FOR VACUUM CLEANER

CROSS REFERENCE TO RELATED APPLICATIONS

This application claims the benefit under 35 U.S.C. 119 of U.S. Provisional Patent Application No. 60/814,616 filed on Jun. 16, 2006 and Korean Patent Application No. 10-2006-0069378 filed on Jul. 24, 2006, the entire contents of each of which are incorporated by reference herein.

BACKGROUND OF THE INVENTION

1. Field of the Invention

The present disclosure relates to a dust collecting apparatus for a vacuum cleaner, and more particularly to a dust collecting apparatus for separating dust entrained in air by rotating the air entrained with the dust.

2. Description of the Related Art

The dust collecting apparatus equipped in a vacuum cleaner generally separates the dirt or dust from external air entrained with the dust. Recently, so called "cyclone dust collecting apparatuses" have become widely used. The cyclone dust collecting apparatus can be semi-eternally used without using a dust bag. Such a dust collecting apparatus separates the dust entrained in the air using a difference of centrifugal force between the air and the dust by rotating the air.

One of the conventional dust collecting apparatuses, which is disclosed in Korean patent No. 560967 by the applicant of this application, is configured such that the dust is discharged in an opposite direction of gravity and the air separated from the dust is discharged in a direction of gravity. Herein, as the cyclone chamber is positioned in a center of a dust collection chamber, the dust flows into the cyclone chamber rotates and rises along the cyclone chamber and then exits the cyclone chamber, into the dust collection chamber outside the cyclone chamber by the centrifugal force.

In the conventional dust collecting apparatus, if a large volume of dirt flows into the dust collecting apparatus during operation of the cleaner, there occurs a problem in that the large volume of dirt can not exit the cyclone chamber or outlet pipe but remains within it, which results in decreasing suction force of the cleaner. Besides, since the user can not determine when the large volume of dirt remains, he has to disconnect the dust collecting apparatus from the cleaner body and then open a cover of it for the purpose of observing.

Additionally, in the conventional dust collecting apparatus, the dust canister has to be manufactured larger so as to increase an amount of dust collected, which results in increasing the size of the dust collecting apparatus. Accordingly, a solution to maintain the dust collecting apparatus in compact is necessary.

SUMMARY OF THE INVENTION

The present disclosure has been developed in order to solve the above and other problems associated with the related art. An aspect of the present disclosure is to provide a dust collecting apparatus, which ensures better visibility in order to see through the cyclone chamber placed within the dust collecting apparatus from outside even in the event that a large amount of dirt has accumulated in the dust collection chamber.

Another aspect of the present disclosure is to provide a dust collecting apparatus, which allows a dust collection chamber to be made larger while maintaining the dust collecting apparatus in a compact size.

In order to achieve one aspect of the present disclosure, there is provided a dust collecting apparatus which is removably connected to a cleaner body. The apparatus includes a cyclone body which forms a cyclone chamber having air entrained with dirt flowed and rotated and is in fluid communication with an air inlet passage on one side thereof; an exit pipe which is protruded from a bottom of the cyclone body to an upper side of the cyclone chamber; and a dust canister body which has an exposure surface of which one side is exposed to outside of the cleaner body upon mounting in the cleaner body, and surrounds the cyclone body so as to form a dust collection chamber between the cyclone body and the dust canister body, wherein the cyclone body is arranged eccentrically within the dust collection chamber so that a portion of the cyclone body has a common portion contacted with a portion of the exposure surface of the dust canister body, and at least the common portion is made of transparent materials to see through the cyclone chamber.

Furthermore, in order to achieve some aspects of the present disclosure, there is provided a dust collecting apparatus, which is removably connected to a cleaner body. The dust collecting apparatus includes a cyclone body, which forms a cyclone chamber having air entrained with dirt flowed and rotated and is in fluid communication with an air inlet passage on one side thereof; an exit pipe which is protruded from a bottom of the cyclone body to an upper side of the cyclone chamber; and a dust canister body which has an exposure surface of which one side is exposed to outside of the cleaner body upon mounting in the cleaner body, and surrounds the cyclone body so as to form a dust collection chamber between the cyclone body and the dust canister body, wherein the cyclone body is arranged eccentrically within the dust collection chamber so that the cyclone body has a protruded portion exposed from the exposure surface of the dust canister body, and at least the protruded portion is made of transparent materials in order to see through the cyclone chamber.

Preferably, all of the cyclone bodies can be made of transparent materials.

Furthermore, in order to achieve some aspects of the present disclosure, there is provided a dust collecting apparatus which is removably connected to a cleaner body. The dust collecting apparatus includes a cyclone body which forms a cyclone chamber having air entrained with dirt flowed and rotated and is in fluid communication with an air inlet passage on one side thereof; an exit pipe which is protruded from a bottom of the cyclone body to an upper side of the cyclone chamber; and a dust canister body which has an exposure surface of which one side is exposed to outside of the cleaner body upon mounting in the cleaner body, and surrounds the cyclone body so as to form a dust collection chamber between the cyclone body and the dust canister body, wherein the cyclone body is arranged eccentrically within the dust collection chamber.

Preferably, the dust collecting apparatus includes a plurality of cyclone chambers.

Preferably, the cyclone chamber further comprises a helical guide for enhancing a rotating force of the air flowed into the air inlet port, and the helical guide is colored lighter than the cyclone body in order to facilitate ascertaining whether the dirt is flowing into the cyclone body.

Furthermore, the cyclone chamber may further comprise a cover for closing/opening the dust canister body, which is removably connected to an upper portion of the dust canister body. An air inlet passage runs through one side of the dust canister body and is in fluid communication with the cyclone chamber, and the cyclone body forms a dust discharge port between a top thereof and a bottom of the cover for discharging the dust into the dust collection chamber through the dust discharge port after rotating and rising the air entrained with dust which is flowed from one side of the cyclone body through the air inlet passage

BRIEF DESCRIPTION OF THE DRAWINGS

The above and other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
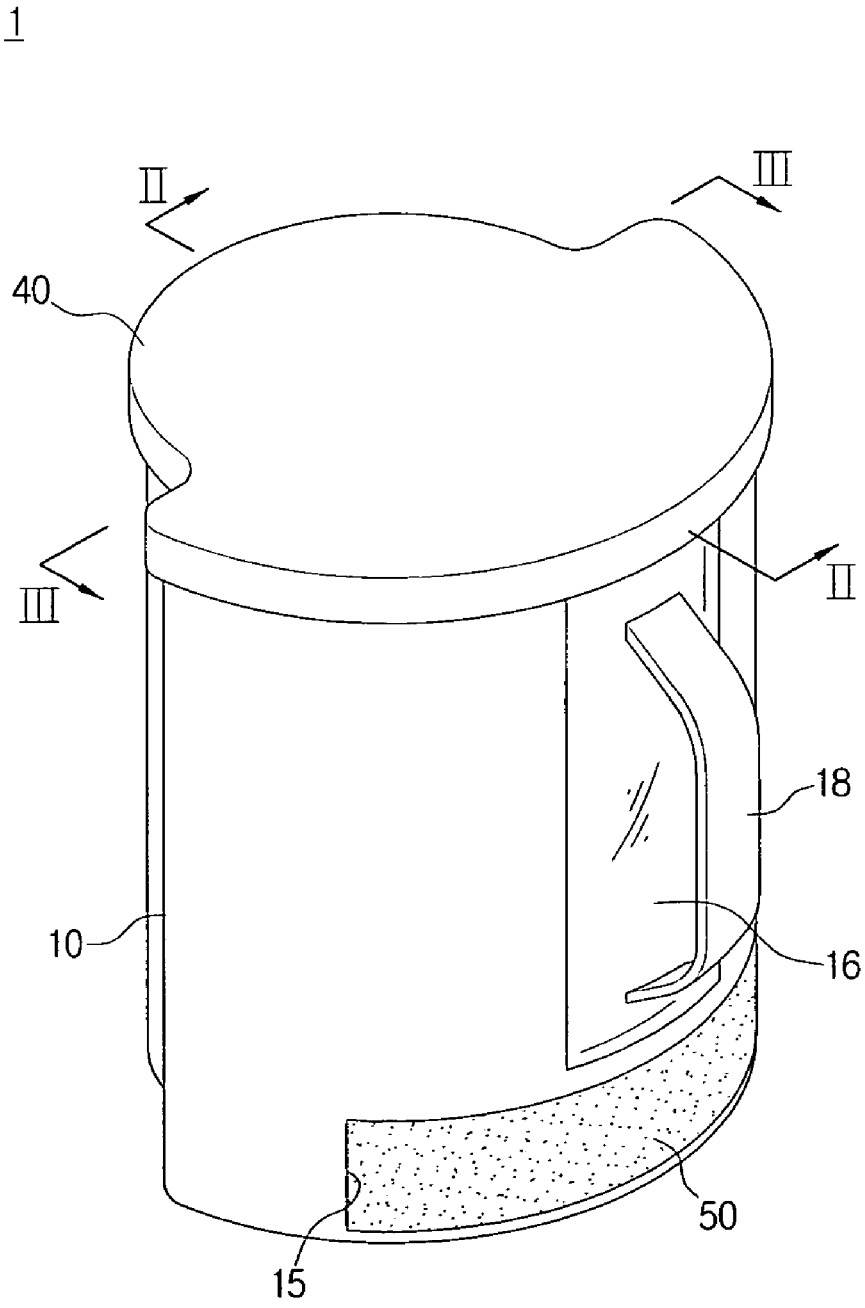
FIG. 1 illustrates a dust collecting apparatus for a vacuum cleaner according to a first embodiment of the present disclosure.

A dust collecting apparatus for a vacuum cleaner according to first embodiment of the present disclosure will be described in greater detail with reference to the accompanying drawings. The dust collecting apparatus is generally referred to by reference numeral 1.

Figure 2:
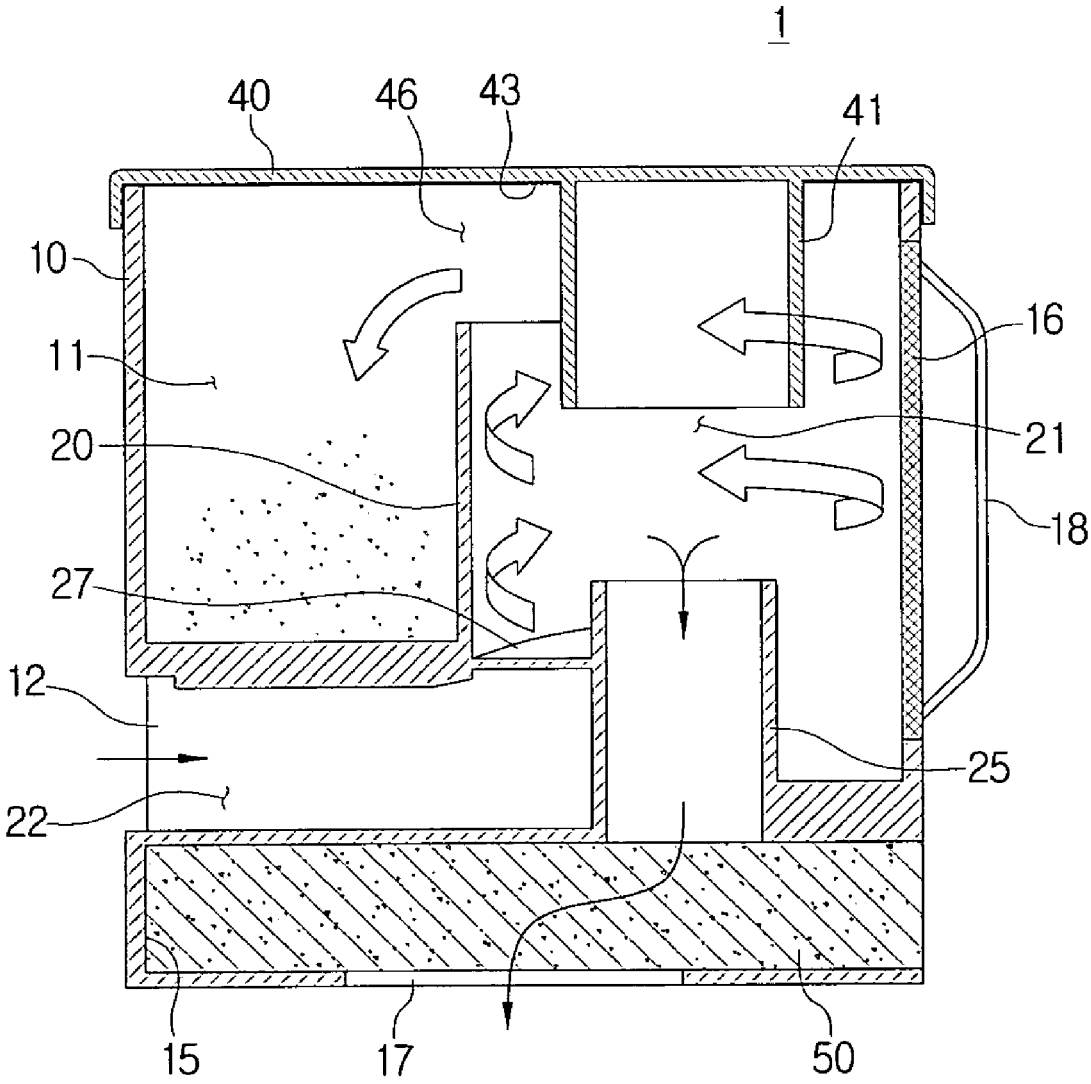
FIG. 2 is a cross-sectional view taken along a line II-II shown in FIG. 1.
Figure 3:
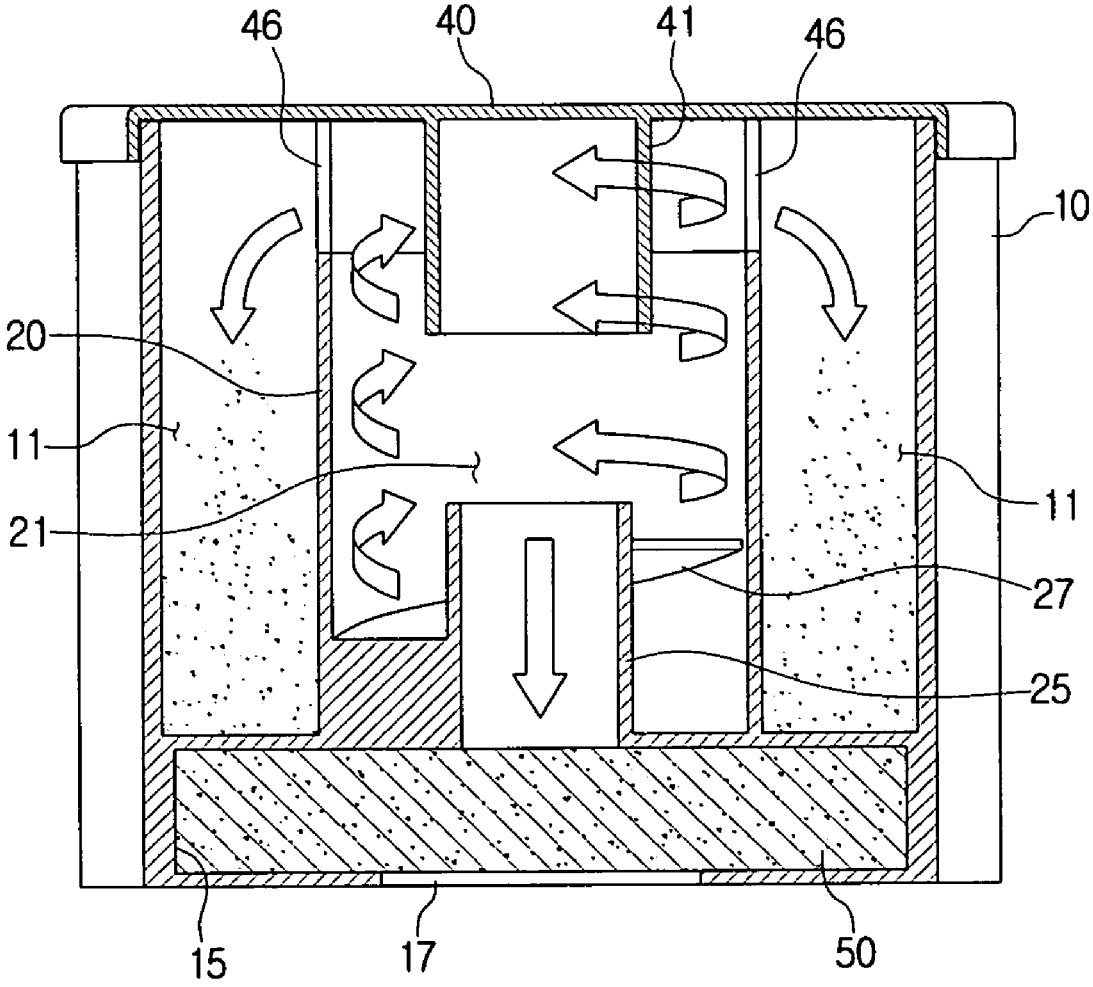
FIG. 3 is a cross-sectional view taken along a line III-III shown in FIG. 1.
Figure 4:
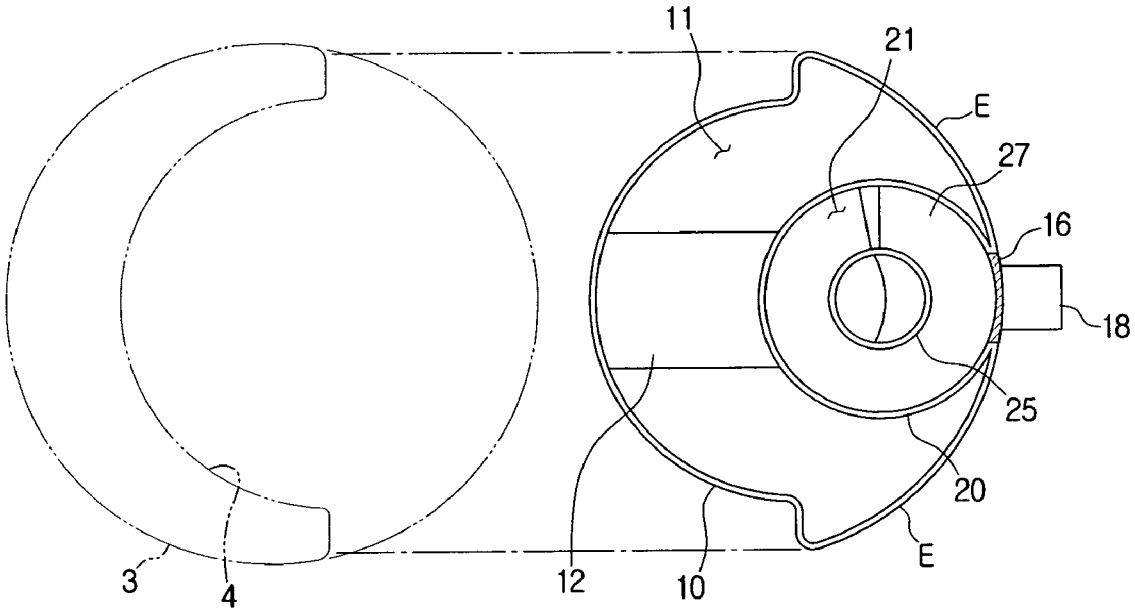
FIG. 4 is a plan view illustrating a state that the dust collecting apparatus shown in FIG. 2 is uncovered.

FIGS. 1 to 4 illustrate first embodiment of a dust collecting apparatus 1 of the present disclosure. FIG. 1 is a perspective-view illustrating a state that a cover 40 is coupled with a dust canister body 10, FIG. 2 is a cross-sectional view taken along a line II-II shown in FIG. 1, FIG. 3 is a cross-sectional view taken along a line III-III shown in FIG. 1, and FIG. 4 is a plan view illustrating a state that the dust collecting apparatus shown in FIG. 2 is uncovered.

Firstly, the dust collecting apparatus 1 according to the first embodiment of the present disclosure includes a dust canister body 10, a cyclone body 20 and a cover 40, as shown in FIGS. 1 to 4.

The dust canister body 10 is configured of a generally step-like cylindrical shape surrounding the cyclone body 20 so that a dust collection chamber 11 is formed between the cyclone body 20 and the dust canister body 10. A height of the dust canister body 10 is higher than that of the cyclone body 20. Therefore, as shown in FIG. 3, a dust discharge port 46 is formed between a top of the cyclone body 20 and a bottom of the cover member 40 through which the dust can pass. Such dust discharge port 46 is formed around the top of the cyclone body 20, and the dust is discharged into the dust collection chamber 11 via the dust discharge port 46 by a centrifugal force of the dirt which rotates and rises in the cyclone chamber 21. As such, since the dust collection chamber 11 is arranged to surround the cyclone chamber 21, once the dirt or dust flows into the dust collection chamber 11, it can be prevented from flowing backward to cyclone chamber 21.

Furthermore, the dust canister body 10 is provided with a handle 18 for mounting or removing the dust collecting apparatus 1 into/from a safe receipt groove 4 of a vacuum cleaner body 3. When dust canister body 10 is mounted in vacuum cleaner body 3, one surface of the dust canister body 10 is exposed outside the cleaner body 3, i.e., exposure surface E, as shown in FIG. 4. Meanwhile, the dust canister body 10 has a filter inserting groove 15 formed on a bottom thereof for inserting the filter 50. Such filter inserting groove 15 is in fluid communication with a bottom of an outlet pipe 25 in an upper portion thereof, and has an exhaust opening 17 formed for exhausting the air which passes through the outlet pipe 25 and the filter 15 in a lower portion thereof.

The cyclone body 20 includes the cyclone chamber 21 for rotating the air and the dirt entrained in the air. The cyclone body 20 also includes an air inlet passage 22, an outlet pipe 25, and a helical guide 27. The air inlet passage 22 is in fluid communication with the air inlet port 12 formed outside the dust canister body 10 and then horizontally runs through the dust canister body 10 so as to be in fluid communication with the cyclone chamber 21. At this case, the air inlet port 12 is connected with a suction brush (not shown) of the vacuum cleaner to function as a passage through which the external air entrained with dirt or dust flows into the cyclone chamber 21. Such air inlet port 12 is formed outside the dust canister 20 in the present embodiment, and alternatively it may be formed in such a manner as to run through a lower portion of the cyclone chamber 21 from the bottom of the dust canister body 10. The outlet pipe 25, through which the air separated from the dirt is exhausted, protrudes vertically from an upper side of the cyclone chamber 21.

A helical guide 27 is configured of helical shape in such a manner to go upward while surrounding the outer circumference surface of the outlet pipe 25 starting from a point that is in fluid communication with the air inlet passage 22, and guides the air along the air inlet passage 22 so that the air may rise while rotating with the outlet pipe 25 as a center. The outlet pipe 25 is a straight pipe-shaped passage for exhausting the air separated from the dust by the cyclone chamber 21 into outside of the dust collecting apparatus, and functions as a rotating center to rotate the air, which passes through the air inlet port 12 and the air inlet passage 22 consecutively.

The cyclone body 20 is arranged eccentrically to one side within the dust collection chamber 11 so that one circumference surface thereof has a common portion 16 which is integrally contact with one circumference surface of the dust canister body 10. The common portion 16 is preferably located in a portion of the exposure surface E of the dust canister body 10 exposed outside the cleaner body 3, if the dust collecting apparatus 1 is mounted into the safe-receipt groove of the cleaner body 3. The common portion 16 is made of transparent materials for so that the user can see through the cyclone body 20 even during operation of the cleaner without the need to disconnect the dust collecting apparatus 1 from the cleaner body 3. In this manner, the user can directly ascertain whether the dirt is flowing into the cyclone chamber 21 across the helical guide 27 with a naked eye by means of the common portion 16. Subsequently, it is possible to avoid pressure loss of the cyclone chamber 21, even if the large volume of dirt remains in the helical guide 27 of the cyclone chamber 21.

In some embodiments, to observe the dirt flowing into the cyclone chamber 21 with the naked eye more apparently, the helical guide 27 advantageously can be colored lighter than the cyclone body 20, for example, yellow. Furthermore, if overall cyclone body 20 is made of transparent materials, the user can ascertain an amount of dirt collected in the dust collection chamber 11 via the transparent cyclone body 20 so that he can easily determine when to discharge the dirt. Furthermore, even in a case that the large amount of dust is accumulated into the dust collection chamber 11, the user can ascertain the amount of dust of the cyclone chamber 21 from outside by means of the common portion of the cyclone body 20 and the dust canister body 10.

The cover member 40 is removably mounted in the top of the dust canister body 10 so that it is spaced from the top of the cyclone body 20 at a distance and closely adhered to the top of the dust canister body 10 to close up the dust collection chamber 11. The rotating guide member 41 is protruded on the bottom 43 of the cover member 40, and is preferably positioned in a location inserted into a center portion of the cyclone chamber 21 upon locating it on the top of the dust canister body 10. According to this embodiment, the rotating guide member 41 is pipe-shaped, and is responsible for maintaining or increasing the rotational force of the dust which rises while rotating towards the dust discharge port 46, which results in enhancing efficiency of the dust discharge into the dust discharge port 46. As such, according to this embodiment, it is possible to prevent from spilling of the dust collected in the dust collection chamber 11 when emptying the dust collecting apparatus 1 after disconnecting it from the cleaner body.

The cyclone body 20 may be arranged such that a portion thereof is in contact with the dust canister body 10 as described above, and may be alternatively arranged within the dust collection chamber 11 as shown in FIGS. 5 to 8. Here, component parts performing similar or analogous functions are labeled in multiples of one hundred.

Figure 5:
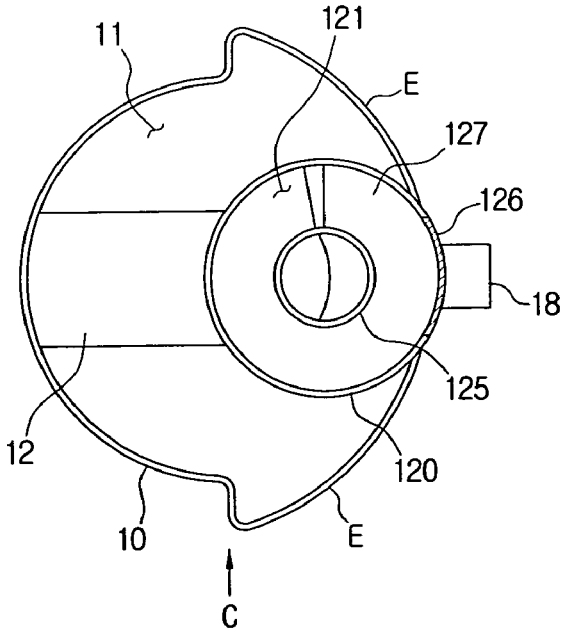
FIG. 5 is a plan view illustrating an example in which a portion of the cyclone body is arranged to be protruded from the dust canister body according to a second embodiment of the present disclosure.
Figure 6:
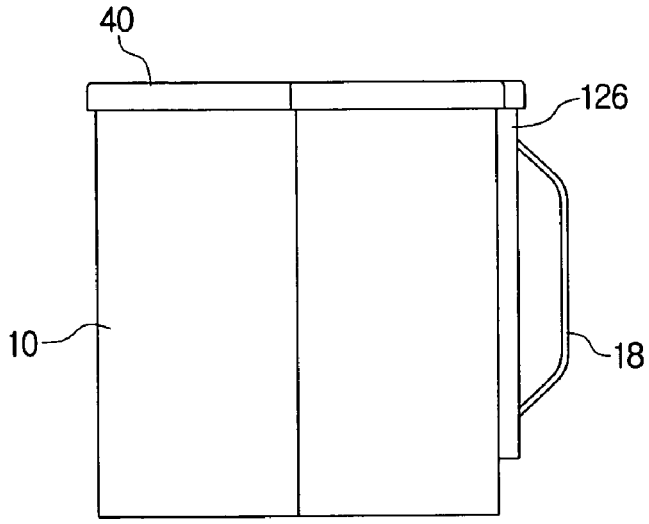
FIG. 6 is side view when viewing from a direction C shown in FIG. 5.

Firstly, FIG. 5 and FIG. 6 illustrate a second embodiment of the present disclosure in which the cyclone body 120 is arranged eccentrically to the exposure surface E of the dust canister body 10 and a portion of the cyclone body 120 is arranged to protrude from the dust canister body 10 thereby to form a protruded portion 126. In this case, the protruded portion 126 is preferably made of transparent materials in order to see into the cyclone chamber 121. Furthermore, since the second embodiment has protruded portion 126, the dust collection chamber 11 can ensure availability of space for collecting the dust into the dust collection chamber 11 as a space corresponding to the protruded portion 126. Therefore, it is possible to make the dust collection chamber 11 larger without increasing the size of the dust canister body 10, which results in maintaining the dust collecting apparatus in a compact form. Reference numeral 127 of FIG. 5 refers to the helical guide, while reference numeral 125 refers to the outlet pipe.

Figure 7:
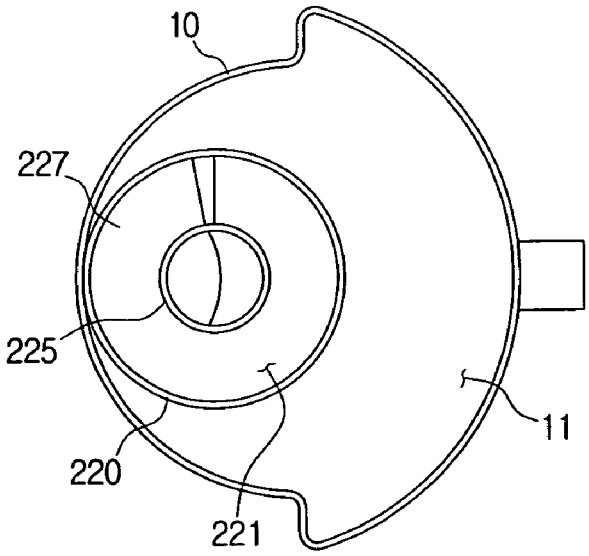
FIG. 7 is a plan view illustrating an example in which a portion of the cyclone body is arranged at a rear side of the dust canister body according to a third embodiment of the present disclosure.

Furthermore, FIG. 7 illustrates a third embodiment of the present disclosure wherein the cyclone body 220 can be arranged eccentrically to an opposite side of the exposure surface E, where the exposure surface E and the cyclone body 220 are preferably made of transparent materials in order to enhance visibility of the cyclone body 220. In addition, the helical guide 227 is preferably colored lighter than the cyclone body 220 in order to apparently observe the process of the dust flowing into the cyclone chamber 221, which results in maximizing visibility. Reference numeral 225 of FIG. 7 refers to the outlet pipe.

Figure 8:
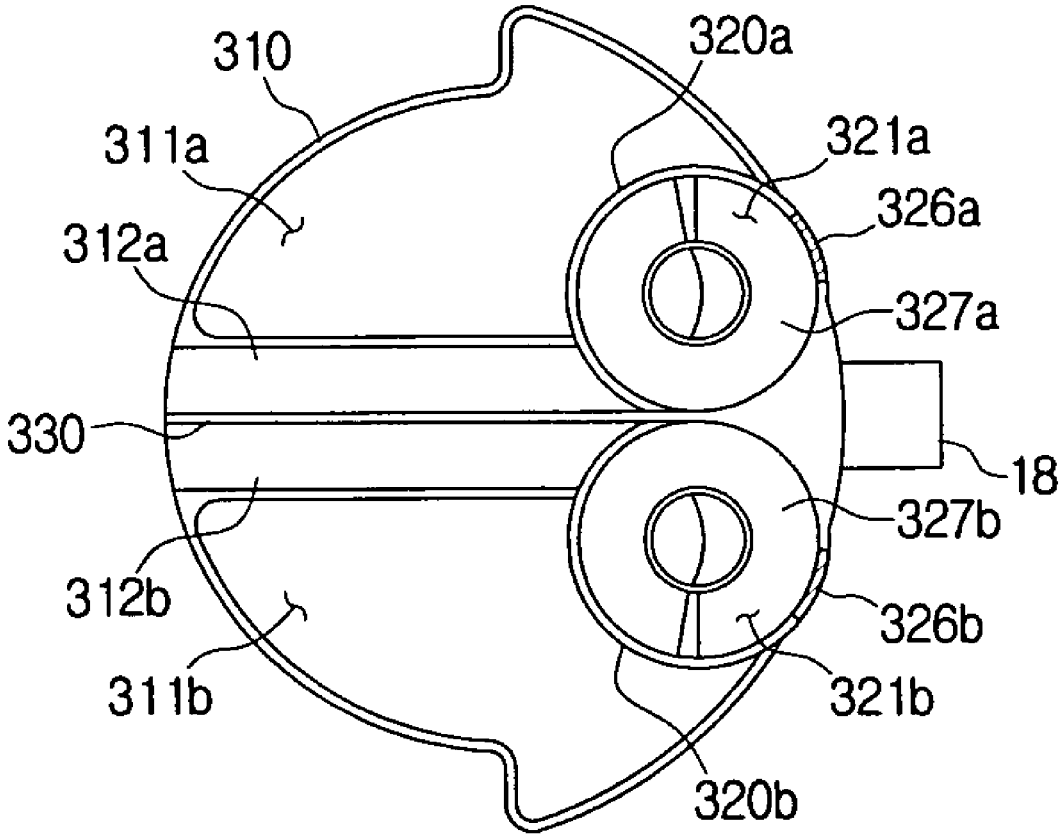
FIG. 8 is a plan view illustrating an example in which a portion of a pair of cyclone bodies is arranged to be protruded from the dust canister body according to a fourth embodiment of the present disclosure.

Furthermore, as shown in FIGS. 1 to 7, the above embodiments were described as examples in which the cyclone body 20, 120, 220 is arranged as single body within the dust collection chamber 11, while the fourth embodiment of the present disclosure, shown in FIG. 8, is configured such that the cyclone body includes of a pair of bodies 320*a*, 320*b*. Herein, a portion of each of the pair of cyclone body 320*a*, 320*b* may be arranged to be protruded from the dust canister body 310 within the dust collection chamber 311*a*, 311*b*. In this case, the pair of cyclone bodies 320*a*, 320*b* cause the air to flow via a pair of air inlet passages 312*a*, 312*b* that run through one side of the dust canister body 310, respectively. Furthermore, the dust collection chambers 311*a*, 311*b* are divided by a partition 330 so that the dust discharged from the pair of cyclone bodies 320*a*, 320*b* is collected into the dust collection chambers 311*a*, 311*b* respectively. Reference numeral 321*a* and 321*b* refer to the cyclone chamber, and 327*a* and 327*b* refer to the helical guide in FIG. 8.

According to the dust collecting apparatus which are described in the first to fourth embodiment of the present disclosure, the cyclone bodies 20, 120, 220, 321*a*, 321*b* are arranged eccentrically to various locations within the dust collection chambers 11, 311*a*, 311 *b* with being contact with or protruded from the dust canister bodies 10, 310, and the common portion 16 or the protruded portions 126, 326*a*, 326*b* are made of transparent materials, so that the dust collection chamber 11, 311*a*, 311*b* or the cyclone chambers 21, 121, 221, 321*a*, 321*b* are visible, thereby observing inside of the cyclone body. Furthermore, the helical guides 27, 127, 227, 327*a*, 327*b* formed in each of the cyclone chambers 21, 121, 221, 321*a*, 321*b* are colored so that the dust flowing into the cyclone chambers 21, 121, 221, 321*a*, 312*b* along the helical guides 27, 127, 227, 327*a*, 327*b* can be easily observed.

As described above, in accordance with the dust collecting apparatus of the present disclosure, since the cyclone chamber is visible so that the dust flows into the cyclone chamber can be observed with the naked eye during operation of the cleaner, it is possible to prevent from degrading the suction force by avoiding a loss of pressure within the dust collecting apparatus, even if the large volume of dirt remains in the cyclone chamber. Furthermore, it is possible to observe the amount of dirt collected into the dust collection chamber without disconnecting the dust collecting apparatus from the cleaner, thereby easily determining when to discharge the dirt.

Furthermore, even if the large amount of dirt is collected in the dust collection chamber, it is possible to ensure visibility of it by means of the common portion or the protruded portion.

Furthermore, as the cyclone body is arranged to protrude from the dust canister body, it is possible to enlarge space of the dust collection chamber, thereby increasing the amount of dirt collected while maintaining the dust collecting apparatus in compact design.

Although a few exemplary embodiments of the present disclosure have been shown and described, it would be appreciated by those skilled in the art that changes may be made in these exemplary embodiments without departing from the principles and spirit of the disclosure, the scope of which is defined in the claims and their equivalents.

What is claimed is:

1. A dust collecting apparatus for a vacuum cleaner which is removably mounted to a cleaner body, the apparatus comprising:

an air inlet port through which external air entrained with dust is introduced;

a cyclone body which forms a cyclone chamber wherein the external air is introduced through the air inlet port is made to whirl and the dust is separated therefrom, the cyclone body being formed transparently so that the cyclone chamber is visible therethrough; and a dust canister body which surrounds the cyclone body so as to form a dust collection chamber between the cyclone body and the dust canister body, and at least one portion of which is formed transparently so that the dust collection chamber is visible therethrough, wherein the cyclone body is arranged eccentrically with respect to the dust canister body, wherein the dust canister body has an exposure surface that is exposed to an outside of the cleaner body when the apparatus is mounted in the cleaner body, wherein the cyclone body and the dust canister body have a common portion which is an overlapping portion of the cyclone body and the dust canister body, and wherein the exposure surface includes the common portion.

2. The apparatus as claimed in claim 1, wherein the common portion protrudes further outward than other portions of the cyclone body adjacent to the common portion.

3. The apparatus as claimed in claims 1, wherein the cyclone body comprises a plurality of cyclone bodies.

4. The apparatus as claimed in claim 1, further comprising an outlet pipe which protrudes upward from a bottom surface of the cyclone chamber.

5. The apparatus as claimed in claim 4, wherein the external air is introduced into one side of a lower portion of the cyclone chamber through the air inlet port, and is discharged via the outlet pipe and through the bottom surface of the cyclone chamber.

6. The apparatus as claimed in claim 4, further comprising:

a filter for removing fine dust particles remaining in the air discharged through the outlet pipe; and a filter inserting groove into which the filter is inserted.

7. The apparatus as claimed in claim 6, wherein the filter inserting groove is formed on a bottom side of the dust collecting apparatus.

8. The apparatus as claimed in claim 4, further comprising a rotating guide member for maintaining a rotational force on the dust which rises in the cyclone chamber, the rotating guide member protruding downward from a top surface of the cyclone chamber.

9. The apparatus as claimed in claim 8, further comprising a cover member for opening and closing one of an upper portion and a lower portion of the dust collecting apparatus.

10. The apparatus as claimed in claim 9, wherein the cover member covers the upper portion of the dust collecting apparatus, and the rotating guide member protrudes from a bottom surface of the cover member.

* * * * *

UNITED STATES PATENT AND TRADEMARK OFFICE

CERTIFICATE OF CORRECTION

PATENT NO. : 7,686,861 B2
APPLICATION NO. : 11/603769
DATED : March 30, 2010
INVENTOR(S) : Jang-keun Oh It is certified that error appears in the above-identified patent and that said Letters Patent is hereby corrected as shown below:

In the claims

Column 6, lines 65-67 and Column 7, lines 1-23

Claim 1 has been amended as follows:

(Currently amended) A dust collecting apparatus for a vacuum cleaner which is removably mounted to a cleaner body, the apparatus comprising: an air inlet port through which external air entrained with dust is introduced; a cyclone body which forms a cyclone chamber where[[in]] the external air [[is]] introduced through the air inlet port is made to whirl and the dust is separated from the external air, the cyclone body formed transparently so that the cyclone chamber is visible through the cyclone body; and a dust canister body which surrounds the cyclone body to form a dust collection chamber between the cyclone body and the dust canister body, of which a portion is formed transparently so that the dust collection chamber is visible through the dust canister body, wherein the cyclone body is arranged eccentrically with respect to the dust canister body, wherein the dust canister body has an exposure surface that is exposed to an outside of the cleaner body when the apparatus is mounted to the cleaner body, wherein the cyclone body and the dust canister body have a common portion which is an overlapping portion of the cyclone body and the dust canister body, wherein the exposure surface includes the common portion.

Signed and Sealed this
Tenth Day of May, 2016

Michelle K. Lee

Michelle K. Lee
*Director of the United States Patent and Trademark Office*